United States Patent [19]
Alexander
[11] 4,167,541
[45] Sep. 11, 1979

[54] CONTINUOUS CARRIERLESS DYEABLE POLYESTERS

[75] Inventor: William Alexander, Charlotte, N.C.

[73] Assignee: Fiber Industries, Inc., Charlotte, N.C.

[21] Appl. No.: 796,267

[22] Filed: May 12, 1977

[51] Int. Cl.[2] ..... C08L 67/02; D01F 6/84; D01F 6/88; D01F 6/92

[52] U.S. Cl. ..... 525/444; 8/DIG. 4; 264/78; 264/176 R; 264/176 F

[58] Field of Search ..... 8/DIG. 4; 260/860; 264/176 R, 176 F

[56] References Cited

U.S. PATENT DOCUMENTS

| | | | |
|---|---|---|---|
| 3,117,107 | 1/1964 | Stimpson et al. | 8/DIG. 4 |
| 3,607,804 | 9/1971 | Nishimura | 8/DIG. 4 |
| 3,652,714 | 3/1972 | Berger | 260/860 |
| 3,948,831 | 4/1976 | Cohn | 8/DIG. 4 |
| 3,988,387 | 10/1976 | Chimura et al. | 260/860 |

FOREIGN PATENT DOCUMENTS

| | | | |
|---|---|---|---|
| 769405 | 3/1957 | United Kingdom | 260/860 |
| 1242700 | 8/1971 | United Kingdom | 260/860 |

*Primary Examiner*—Allan Lieberman
*Attorney, Agent, or Firm*—Robert J. Blanke

[57] ABSTRACT

A continuous, carrierless dyeable polyester fiber and the process for its preparation is set forth. The fiber is produced from a polymer obtained by producing a melt blend system comprising a homogenous blend of (a) not less than 78 percent by weight of poly(ethylene terephthalate) copolymerized with major amounts of a dicarboxylic acid other than terephthalic acid and (b) minor amounts, that is to say, quantities less than that of said dicarboxylic acid, of a homopolymer selected from the group consisting of poly(trimethylene terephthalate), poly(tetramethylene terephthalate), poly(pentamethylene terephthalate), poly(hexamethylene terephthalate), poly(heptamethylene terephthalate), poly(octamethylene terephthalate), poly(nonamethylene terephthalate) and poly(decamethylene terephthalate).

11 Claims, 4 Drawing Figures

CONTINUOUS CARRIERLESS DYEABLE POLYESTERS

This invention relates to film- and fiber-forming polyesters which are readily dyeable and more specifically to poly(ethylene terephthalate) fibers which have sufficient affinity for disperse dyestuffs such as to be continuously dyeable to heavy shades without the use of a carrier and/or without high pressure.

Polyester fibers are known to be difficult to dye and in order to adequately dye these fibers in aqueous systems, special high pressure equipment and/or dye baths containing carriers are commonly employed. Carrier dyeing of synthetic polymers makes use of agents which have a pronounced swelling effect upon the fiber, making room for the large dye molecules to penetrate or be "carried" into the fiber. Phenolics, such as ortho, meta or para phenyl phenol, creosole, and biphenol, have proven best for poly(ethylene terephthalate). However, trichlorobenzene and methylsalycilate, among others, are also carriers for poly(ethylene terephthalate). Since the carriers are water insoluble, they are used either as water soluble salts (sodium salts for phenols) or as emulsions. Many proprietary carriers are principally stable emulsions of these carriers. Thorough removal of all traces of most carriers is necessary or light fastness will be markedly decreased.

A substantial portion of ortho-phenyl phenol, one of the most used carriers, can be removed by caustic scour at the boil. However, the only completely effective method known for removing ortho-phenyl phenol is sublimation at high temperatures such as used for resin curing. Obviously, the use of carriers vastly increases the cost of dyeing polyester. Moreover, certain of the phenolic carriers are known to be air and water pollutants and hence the use of such carriers must be closely controlled for environmental reasons.

Poly(ethylene terephthalate) is also known to be difficult to dye in continuous nonaqueous systems such as Thermosol and Keuster's dyeing processes wherein dry heat is employed to cause better absorption of colorant. Generally, disperse and vat dyes, selected for their resistance to sublimation when heated, are padded on the goods which are then dried and heated in ovens designed to heat uniformly both sides of a fabric. Fast dyeing of the poly(ethylene terephthalate) is dependent on the migration of the dye into the fiber. It is therefore essential that the dyestuff migrate rapidly in order to make these processes economically feasible but also migrate uniformly so as to prevent streaking of the finished product.

Continuous aqueous systems of dyeing are necessary in order to obtain long yardages of goods dyed the same color. Poly(ethylene terephthalate) is known to be difficult to dye in such systems. The Williams unit is one such system which uses a low liquor/cloth ratio and terrific turbulence to impregnate thoroughly cloth commonly run at speeds of 100 yards per minute. The temperature is accurately controlled and the cloth kept below the liquor level enabling a reducing atmosphere to be maintained. In order for a fabric to be considered suitable for continuous dyeing, the fabric must have the ability to exhaust a dyebath in a limited period of time, preferably less than 10 minutes, and still maintain uniformity in shade and fastness to all conditions to which the goods will be subjected.

Attempts have been made to overcome the dyeing deficiencies of poly(ethylene terephthalate). For instance, U.K. Pat. No. 931,241 teaches that if a small part of the terephthalate of poly(ethylene terephthalate) is replaced by another acid residue, a random copolyester is formed in which the highly ordered molecular structure of poly(ethylene terephthalate) is sufficiently disrupted to facilitate the penetration of dyestuffs, particularly of the disperse acetate type. Sebacate, adipate and glutarate units have been found to be very suitable for the purpose of altering the penetrability of the crystalline structure. Aliphatic dicarboxylic acids will, however, significantly reduce the softening point of poly(ethylene terephthalate) and also create ring dyeing problems due to poor dye penetration of the fiber.

It is also known that the dye uptake of poly(ethylene terephthalate) can be improved by the addition of poly(tetramethylene terephthalate) as disclosed in U.S. Pat. No. 2,899,410. A random copolyester obtained from ethylene glycol, 1:4 butane diol and terephthalic acid wherein the glycol mixture contains between 89 and 95 mol percent of ethylene glycol and between 11 to 5 percent of tetramethylene glycol is found to exhibit increased dye uptake over the homopolyester. The rate of dye uptake, however, is too slow to provide a fiber which can be utilized in continuous dyeing processes. Moreover, the introduction of each mole percent of a random copolymer component will reduce the melting point of the poly(ethylene terephthalate) host polymer by about 3 degrees centigrade. The addition of large molecular entities such as polyethylene glycol will however adequately break up poly(ethylene terephthalate) crystal structure without seriously reducing the melting point. These large copolymer structures, however, produce polymers and fibers with poor dye lightfastness.

Most recently, improved dyeability in poly(ethylene terephthalate) fiber has been obtained by introducing into the polyester polymer major amounts of polybutylene terephthalate together with minor amounts of a dicarboxylic acid other than terephthalic acid. Representative of such systems for obtaining improved dyeability are U.S. Pat. No. 3,988,387 and German OLS No. 25 02 555. While the aforementioned systems do indeed improve the dyeability of poly(ethylene terephthalate) fiber, the rate of dye uptake is not sufficiently fast to be considered a continuous and carrierless dyeable fiber.

It is therefore an object of this invention to produce a continuous and carrierless dyeable poly(ethylene terephthalate) fiber.

It is an additional object of this invention to provide a process for the preparation of a continuous and carrierless dyeable poly(ethylene terephthalate) fiber.

In accordance with this invention, it has now been discovered that a continuous and carrierless dyeable poly(ethylene terephthalate) may be obtained by producing a melt blend system comprising a homogenous blend of (a) not less than 78% by weight of poly(ethylene terephthalate) copolymerized with major amounts, that is to say from 2 to 12 weight percent of a dicarboxylic acid selected from the group consisting of adipic acid, sebacic acid, glutaric acid azelaic acid, isophthalic acid and (b) minor amounts, that is to say, quantities less than that of said dicarboxylic acid and more specifically from 1 to 10 weight percent, based on the total weight of the copolymer, of a homopolymer from the group consisting of poly(trimethylene terephthalate), poly(tetramethylene terephthalate), poly(pentamethylene terephthalate), poly(hexamethylene terephthalate), poly(-heptamethylene terephthalate), poly(octamethylene terephthalate), poly(nonamethylene terephthalate) and poly(decamethylene terephthalate). Preferably, the poly(ethylene terephthalate) is copolymerized with from 6 to 12 weight percent of aliphatic dicarboxylic acid based on the weight of the poly(ethylene terephthalate). Most preferably, the melt blend system comprises an intimate blend of about 81 percent by weight of poly(ethylene terephthalate) copolymerized with 11 percent by weight of adipic acid, based on the weight of the poly(ethylene terephthalate) and 8 percent by weight of poly(hexamethylene terephthalate), based on the total weight of the poly(ethylene terephthalate-co-adipate) copolymer. While conventional polymerization and esterification techniques are employed in the process of this invention, it is essential that the polyester polymers be blended under conditions which will minimize ester interchange whereby a large drop in the melting point of the final product is avoided.

The use of the two component additives of this invention, wherein the dicarboxylic acid component is the preponderant component, results in a poly(ethylene terephthalate) fiber which is carrierless dyeable and wherein the dyeing rate is not only fast enough for continuous carrierless dyeing operations, but the penetration of the dyestuff into the fiber is great enough to minimize ring dyeing problems. Moreover, by employing not more than 12 weight percent of a dicarboxylic acid other than terephthalate acid, a substantial reduction in the melting point of the filamentary end product is prevented. As previously noted, the blending of a second polyester component alone, such as poly(butylene terephthalate) with poly(ethylene terephthalate), will not result in a fiber having a dyeing rate fast enough to be considered continuously dyeable. The blending of a dicarboxylic acid, component alone, such as adipic acid with poly(ethylene terephthalate), will result in a satisfactory dyeing rate but results in excessive ring dyeing due to poor dye penetration of the fiber. Ring dyeing is usually equated to crocking, that is to say, the rubbing off of dye from a fabric as a result of insufficient dye penetration or fixation. Moreover, due to dye migration in thermal treatments subsequent to dyeing, a ring dyed fiber is subject to shade changes as the dyestuff seek to reach an equilibrium condition within the fiber.

In general, continuous dyeing rate is best defined by:

A. Half-time of dyeing ($t_{\frac{1}{2}}$)—the time required to absorb half as much dye as it will in the equilibrium state. The basic experimental method for determining the time of half-dyeing is described in *Vickerstaff Physical Chemistry of Dyeing,* 2nd Edition. For purposes of this invention, a continuous, carrierless poly(ethylene terephthalate) fiber is deemed to be a fiber having a half-time of dyeing ($t_{\frac{1}{2}}$) of about 3 minutes in a saturated atmospheric steamer operated at 98° C.

B. Visual Color Depth - Color depth of shade, as measured instrumentally by, for instance, a Hunter D-25 Color Difference Meter (Hunter Associates Laboratory of Fairfax, Virginia) should show an apparent depth of shade within 10 minutes dyeing time corresponding to approximately 65 units $\Delta L$ (change of color depth$=\Delta L$). This will correspond to about 2.5% on weight of fiber of CI Disperse Blue 56.

Dye penetration, in addition to visual measurements taken from filament cross-sections, may be equated to the crystallization behavior of the polyester polymer. Polyester polymers have two crystallizations characterized by their temperature of occurence, $T_x$ (hot) and $T_x$ (cold). For maximum dye penetration, the polyester polymer of this invention must have a $T_x$ (hot) or crystallization from the melt of less than 190° C.

A better understanding of the invention and the parameters employed in describing the invention may be had from the drawings wherein.

Figure 1:
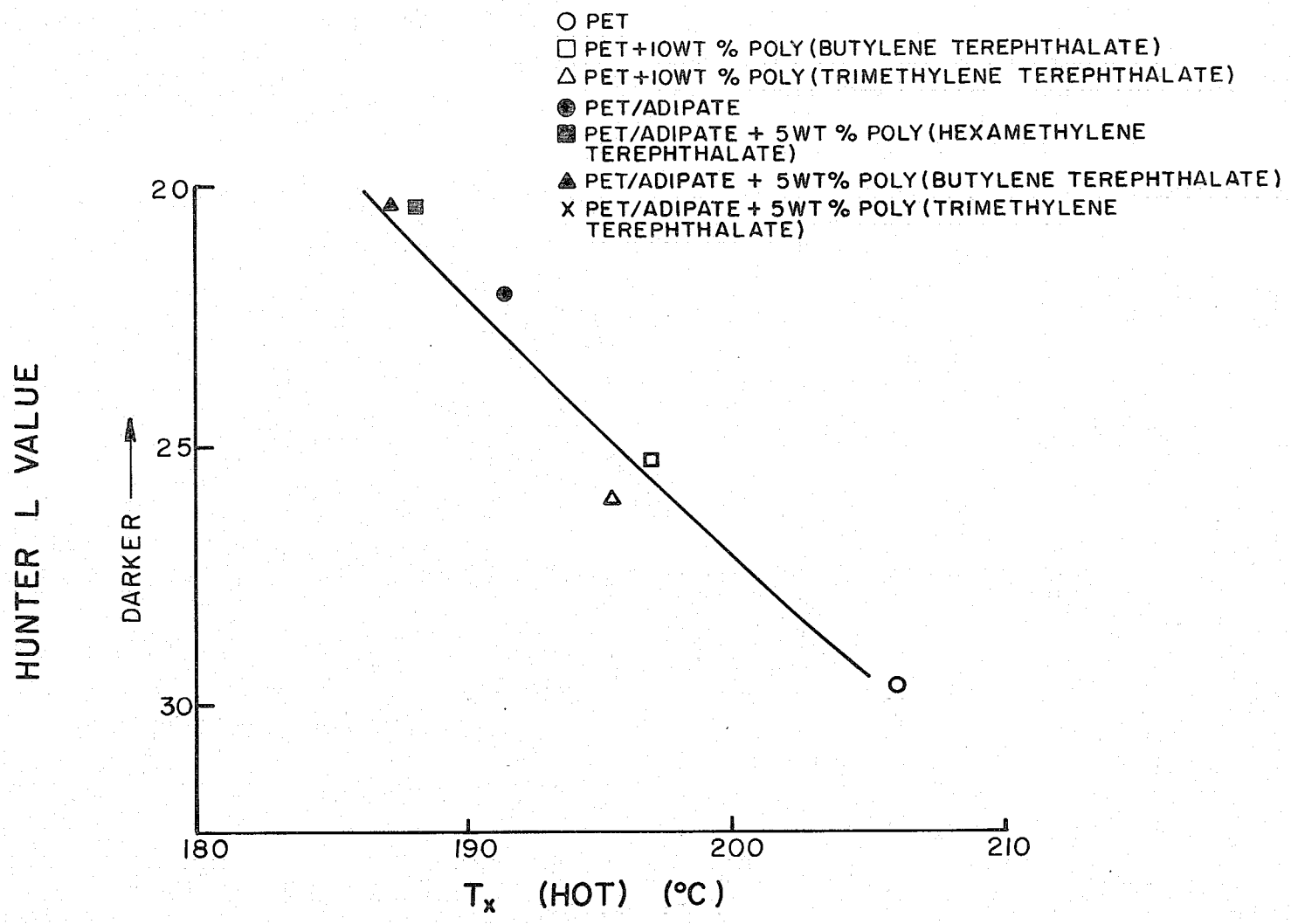
FIG. 1 is a graph of polymer depth shade versus hot crystallization temperatures or crystallization from the melt temperatures, "PET" being an appreviation for poly(ethylene terephthalate).

It should be understood that the abbreviation "PET" which appears in the drawings and the specification is an abbreviation for poly(ethylene terephthalate).

All dyeings reported herein are carried out on either 6 denier per filament staple fiber puffs or on 6 denier per filament 240 total denier yarn knitted into a hose leg. The sample, without any pretreatment, is dyed in an aqueous dye bath containing 5% by weight, based on the weight of the fiber, of C.I. Disperse Blue 56, 1% by weight, based on the weight of the fiber, of Tamal SN (naphthalene formaldehyde dispersant marketed by Rohm and Haas), 0.25% by weight, based on the weight of the fiber, of Sequestrene ST (sequestring type water softener marketed by Ciba Geigy Corp.) and sufficient acetic acid to produce a pH of about 5. The sample is dyed for 10 minutes at the boil and then rinsed in cold water.

As previously noted, depth of penetration of dyestuff is critical to proper dyeing of poly(ethylene terephthalate) fibers. If dye penetration is insufficient, "ring dyeing" will result and as a consequence, dye migration will occur when the ring dyed fiber is subjected to subsequent thermal treatments. If, however, the poly(ethylene terephthalate) fiber has a low hot crystallization or crystallization from the melt temperature, depth of dye penetration will be increased, the depth being measurable as an increase in depth of shade. As can be seen in FIG. 1 of the drawings, those polymers having the lowest crystallization from the melt temperatures, $T_x$ (hot) poly(ethylene terephthalate) containing adipic acid ester and 5 percent by weight of either poly(hexamethylene terephthalate) or poly(butylene terephthalate) exhibit the lower Hunter L values and hence the darkest shades. All samples in FIG. 1 which are noted as adipate samples contain about 8 percent by weight adipate which is equivalent to about 7 weight percent adipic acid. It should be noted that these values are only obtained with the three component systems and not with poly(ethylene terephthalate) alone or with two component systems containing poly(ethylene terephthalate). Preferably, the continuous carrierless dyeable polyester fiber of this invention has a $T_x$ (hot) of less than 190° C.

Figure 3:
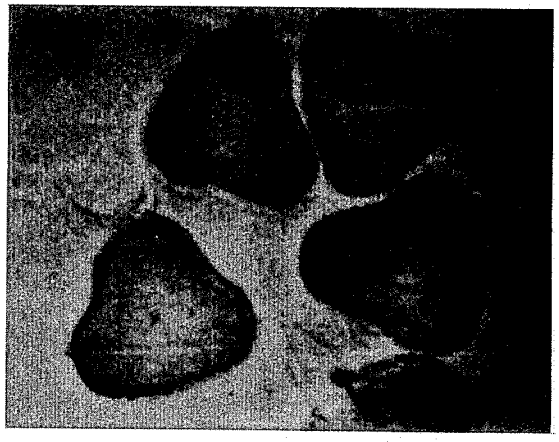
FIG. 3 is a photomicrograph of a cross section of a dyed adipic acid and poly(butylene terephthalate) containing filament.
Figure 4:
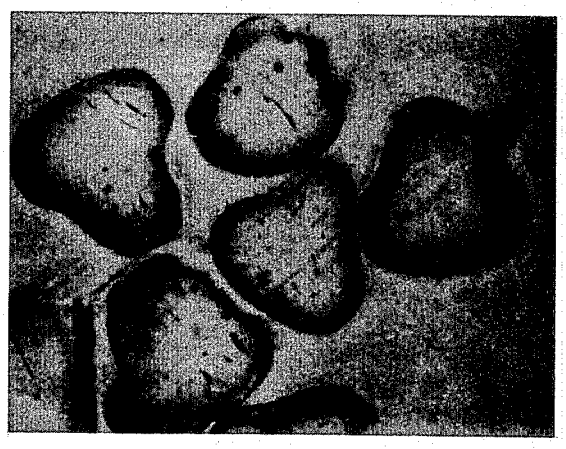
FIG. 4 is a photomicrograph of a cross section of a dyed adipic acid containing poly(ethylene terephthalate) filament.

The $T_x$ (hot) values noted in FIG. 1 of the drawings may be correlated with the fiber cross-sections set forth in FIGS. 3 and 4 of the drawings. FIG. 3 is a photomicrograph of a cross section of a dyed adipic acid and poly(butylene terephthalate) containing filament (magnified 630 times). The polymer contains 8 weight percent of adipate and 5 weight percent of poly(butylene terephthalate) in poly(ethylene terephthalate). The fiber was dyed for 10 minutes in a C.I. Disperse Blue 56 dye bath.

As can be noted by the absence of any dark coloration on the edge of the fiber cross section, the dye has substantially uniformly penetrated the fiber. In contradistinction to FIG. 3 of the drawings, FIG. 4 of the drawings is a photomicrograph (magnified 630 times) of a cross section of a filament of dyed poly(ethylene terephthalate) containing 8 weight percent of adipate alone. The fiber was dyed for 10 minutes with the same dye bath or was employed in obtaining the cross section of FIG. 3. As can be noted, a dark area on the periphery of the filament cross section is illustrative of ring dyeing.

Figure 2:
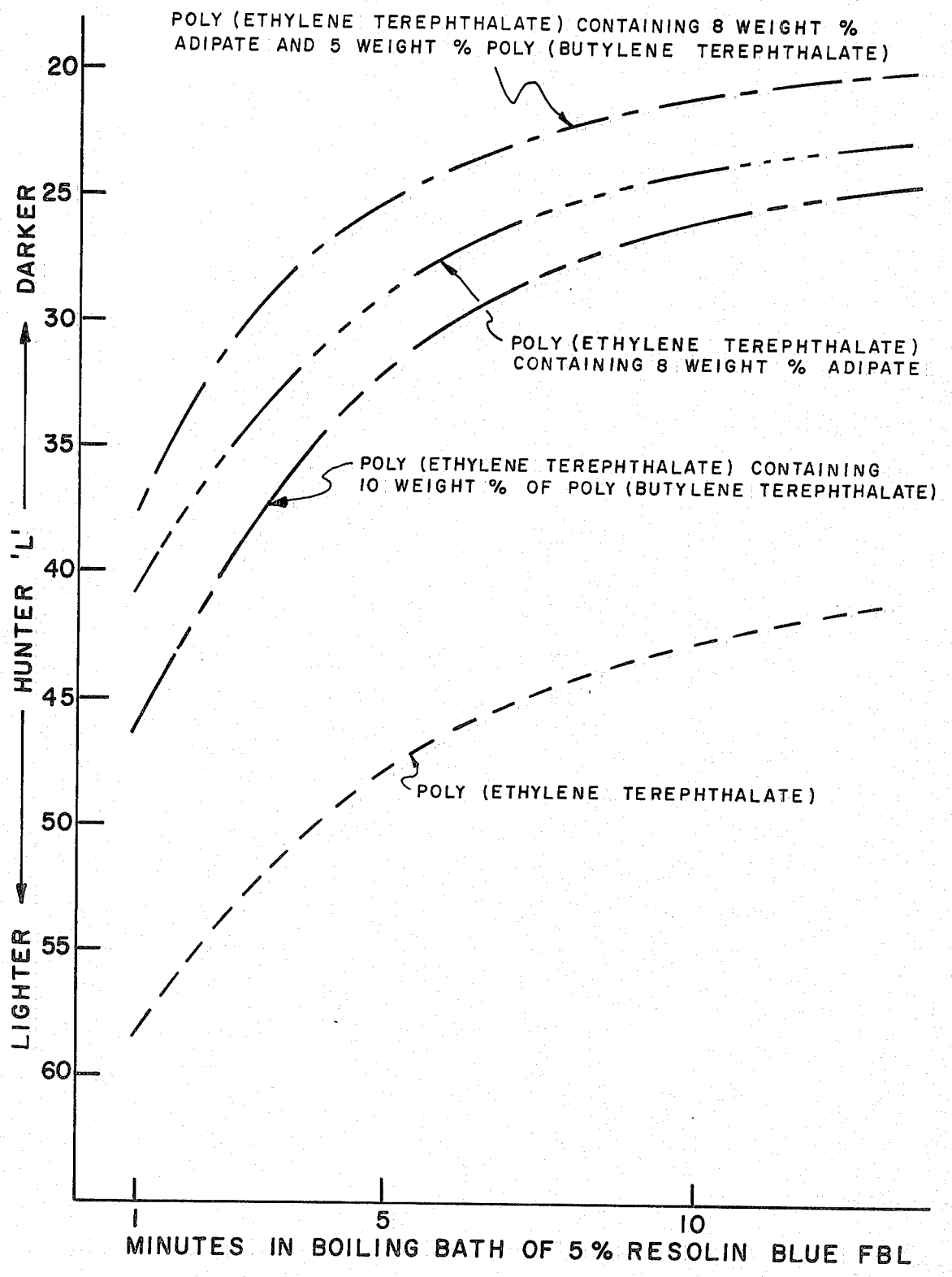
FIG. 2 is a rate dyeing graph plotting minutes in a dye bath against depth of shade.

In addition to proper dye penetration, the poly(ethylene terephthalate) fiber of this invention also has a sufficient rate of dye uptake to render the fiber suitable for continuous dyeing operations as may be seen in FIG. 2 of the drawings. In FIG. 2, samples comprising 6 denier filament staple fiber puffs are dyed in a boiling bath of 5 percent C.I. Disperse Blue 56 (Resolin Blue FBL) and the time in the dye bath is plotted against Hunter L values. As can be seen from the graph, the poly(ethylene terephthalate) containing adipic acid ester and poly(butylene terephthalate) exhibits a faster rate of dye uptake than the two component blends of poly(ethylene terephthalate) alone.

Having generally described the invention, a more detailed understanding may be had from the following examples.

EXAMPLE I

An adipate-terephthalate copolymer containing 8 percent by weight of adipate as determined from repeating adipate units in the polymer product is prepared as follows. A conventional ester interchange reaction is carried out in an autoclave vessel by charging 2.2 moles of ethylene glycol and one mole of dimethyl terephthalate. Lithium acetate dihydrate is optionally added to suppress the formation of diethylene glycol and 0.015 percent w/w zinc acetate is added to the melt at 140 degrees centigrade to act as an ester interchange catalyst. The batch temperature is slowly raised to 225° C. and all the theoretical methanol evolved from the batch is distilled and collected in a receiver. At this point, 7 w/w% of adipic acid (based on dimethyl terephthalate) is charged to the vessel, the melt stirred for 30 minutes and 0.04 w/w% antimony oxide is added. The melt is then polymerized until an intrinsic viscosity of 0.675 is achieved. The polymer is then melt extruded at a temperature of 270° C. through a spinning jet so as to produce a 15 d.p.f. continuous filament yarn which is subsequently drawn to a 6 d.p.f. end product.

EXAMPLE II

The process of Example I is repeated with the exception that the adipic acid addition step is omitted and the resultant polymer is again melt extruded at a temperature of 280° C. through a spinning jet so as to produce a 15 d.p.f. continuous filament yarn which is subsequently drawn to a 6 d.p.f. end product.

EXAMPLE III 3132 parts of butanediol and 2954 parts DMT are placed in an esterification vessel (mole ratio 1.57:1) and 0.5 parts tetrabutyl titanate added as an esterification catalyst. The temperature is raised to approximately 220° C. and the theoretical weight of methanol distilled off via an attached distillation column. A further 1.2 parts tetrabutyl titanate is added to the melt and the melt transferred to a polymerization autoclave. The temperature is raised to 270° C. and vacuum applied until the melt has attained the desired molecular weight level. At this point, 2.8 parts tridecyl phosphite is added as a thermal stabilizer. The batch is stirred for five minutes under vacuum yielding a polymer with an average molecular weight of about 22,000 and a relative viscosity of 36.

EXAMPLE IV

An ester interchange was carried out by charging 2.2 mole of 1,3 propane diol to one mole of DMT. 0.02 w/w% zinc acetate dihydrate and 0.02 w/w% cobalt acetate tetrahydrate were added to the melt to act as an ester interchange catalyst. Other typical ester interchange catalysts also function. The batch temperature was slowly raised to 245° C. All the theoretical methanol evolved and was collected. At this point, 0.04 w/w% antimony oxide and 0.04 w/w% trimethylphosphonate were charged to the vessel. The batch temperature was heated to 255° C. and vacuum was applied until the polymer reached a desired molecular weight.

EXAMPLE V

95% by weight of the polymer of Example I is blended with 5% by weight of the polymer of Example III. In order to reduce the possibility of ester interchange, the polymer of Example I is passed in hot melt state through an extrusion screw at which point the polymer of Example III which has been previously reduced to chip is introduced. The hot melt blend is then extruded and drawn according to the process set forth in Example II.

EXAMPLE VI

95% by weight of the polymer of Example I is blended with 5% by weight of the polymer of Example IV, the polymer of Example I being passed in a hot melt state through an extrusion screw at which point the polymer of Example IV which has been previously reduced to chip is introduced. The hot melt blend is then extruded and drawn according to the process set forth in Example II.

EXAMPLE VII 582 parts of dimethyl terephthalate, 531 parts of 1,6-hexane-diol (molar ratio 1.5:1), and 0.40 parts of tetraisopropyl titanate (11.7 ppm titanium) are placed in a steel polymerization vessel. The temperature of the batch is raised to 200° C. and the theoretical weight of methanol is removed through an attached distillation column while the batch temperature is increased to 270° C. A vacuum is applied to the vessel and the molten polymer until the desired molecular weight is obtained. At this point 0.5 parts of tridecylphosphite (53 ppm phosphorus) is added. The batch is stirred under vacuum for an additional 5 minutes and the molten polymer is extruded from the vessel under a nitrogen atmosphere.

EXAMPLE VIII 95 parts of the polymer of example I (adipate/PET) is blended with 5 parts of the polymer of Example VII.

The hot melt blend is then extruded and drawn according to the process set forth in Example II.

EXAMPLE IX 90 parts of the polymer of Example II (PET) is blended with 10 parts of the polymer of Example IV in the manner described in Example V. The hot melt blend is then extruded and drawn according to the process of Example II.

EXAMPLE X 90 parts of the polymer of Example II (PET) is blended with 10 parts of the polymer of Example III in the manner described in Example V. The hot melt blend is then extruded and drawn according to the precess set forth in Example II.

EXAMPLE XI 90 parts of the polymer of Example II (PET) is blended with 10 parts of the polymer of Example VII in the manner described in Example V. The hot melt blend is then extruded and drawn according to the process set forth in Example II.

TABLE I

Dyeing Comparison of Poly(Ethylene Terephthalate) Blends

| Composition | Hunter L |
|---|---|
| PET (Polymer of Example 2) | 29.7 |
| PET + 10 wt % 3 GT* (Polymers of Examples 2 and 4) | 26.0 |
| PET + 10 wt % 4GT** (Polymers of Examples 2 and 3) | 25.3 |
| PET/8 wt % adipate determined from adipate repeat units (Polymer of Example 1) | 22.1 |
| PET/8 wt % adipate + 5 wt % 3GT* (Polymers of Examples 1 and 4) | 21.8 |
| PET/8 wt % adipate + 5 wt % 4GT** (Polymers of Examples 1 and 3) | 20.6 |
| PET/8 wt % adipate + 5 wt % 6GT*** (Polymers of Examples and 7) | 20.7 |

*Poly (trimethylene terephthalate)
**Poly (Butylene terephthalate)
***Poly (hexamethylene terephthalate)

EXAMPLE XII

A melt blend is prepared from the polymers of the preceeding examples, the poly(tetramethylene terephthalate), poly(butylene terephthalate) or poly(hexamethylene terephthalate) being added in the form of chip to the hot melt just prior to extrusion, the extrudate being a 15 d.p.f. continuous filament yarn which is subsequently drawn to a 6 d.p.f. end product. The specific composition of each melt blend is given in Table I. The dyeing behavior of the yarns thus prepared is evaluated by dyeing hose leg samples of each without carrier in an aqueous dye bath of C.I. Disperse Blue 27. These dyeings are carried out competitively (all samples in the same dye bath) for 45 minutes at the boil. The results of this dyeing study are displayed in Table I with the relative depth of shade expressed in Hunter L units (a lower value signifies a deeper dye shade).

EXAMPLE XIII

In order to determine the dyeability of poly(ethylene terephthalate) containing high levels of a dicarboxylic acid other than terephthalic acid, Example I is repeated except that the reaction vessel is charged with 12 mole % of adipic acid to produce a polymer containing 11 weight % of adipate calculated as adipate repeat units. Additional polymer samples are prepared by melt blending 3.8 weight % and 8 weight % of the polymer chip of Example III with the polymer containing 11 weight % of adipate calculated as adipate repeat units. All polymer samples are extruded as 15 d.p.f. continuous filament yarn which is subsequently drawn to a 6 d.p.f. end product. The dyeing behavior of the yarns thus prepared is evaluated by dyeing hose leg samples of each without carrier in an aqueous dye bath of C.I. Disperse Blue 27 for 10 minutes at the boil. The results of this dyeing study are displayed in Table II with the relative depth of shade expressed in Hunter L units (a lower value signifies a deeper dye shade).

TABLE II

| Composition | Hunter L |
|---|---|
| Poly (ethylene terephthalate) + 11 weight % adipate | 20.5 |
| Poly (ethylene terephthalate) + 11 weight % adipate + 3.8* weight % poly(butylene terephthalate) | 19.5 |
| Poly (ethylene terephthalate) + 11 weight % adipate + 8* weight % poly(butylene terephthalate) | 18 |

*based on the total weight of the adipate copolymer

Polyethylene terephthalate fibers are partially crystalline, hence physical and dyeability properties of the fiber are determined by the distribution of crystal and amorphous material and the orientations of these regions plus the effects of any residual stresses. While not wishing to be bound to the theory behind the increased dye uptake of the fibers of the instant invention, it would appear that the mechanism for their efficiency is the cohabitation of a low glass transition polymer in the amorphous regions of the poly(ethylene terephthalate). This could result in increased segmental mobility at lower temperatures, thus enhancing dye diffusion.

What is claimed is:

1. A continuous carrierless dyeable polyester fiber, said polyester being a melt blend system comprising an intimate blend of (a) not less than 78% by weight of poly(ethylene terephthalate) copolymerized with from 2 to 12% by weight of a dicarboxylic acid selected from the group consisting of adipic acid, sebacic acid, glutaric acid, azelaic acid and isophthalic acid and (b) a polyester homopolymer selected from the group consisting of poly(trimethylene terephthalate), poly(tetramethylene terephthalate) and poly(hexamethylene terephthalate), said polyester homopolymer being present in weight percentages of from 1 to 10% based on the total weight of the copolymer, said component (a) being produced by preparing a terephthalate ester melt and, prior to polymerization thereof, adding said dicarboxylic acid to the melt and then polymerizing the melt.

2. The product of claim 1 wherein said dicarboxylic acid is an aliphatic dicarboxylic acid.

3. The product of claim 1 wherein from 6% to 12% by weight of dicarboxylic acid is copolymerized with said poly(ethylene terephthalate).

4. The product of claim 1 wherein said aliphatic dicarboxylic acid is adipic acid.

5. The product of claim 1 wherein said polyester homopolymer is poly(hexamethylene terephthalate).

6. The product of claim 1 wherein said aliphatic dicarboxylic acid is adipic acid and said polyester homopolymer is poly(hexamethylene terephthalate).

7. The product of claim 1 having a crystallization from the melt temperature of less than 190° C.

8. The product of claim 1 dyed with a disperse dyestuff from an aqueous system.

9. The product of claim 1 dyed with a disperse dyestuff from a nonaqueous system.

10. The product of claim 1 wherein said aliphatic dicarboxylic acid is adipic acid present in amounts of about 7% by weight and said polyester homopolymer is poly(hexamethylene terephthalate) present in amounts of about 5% by weight, based on the total weight of said copolymer.

11. In a process for the preparation of a carrierless dyeable polyester fiber by extrusion of a hot melt, the improvement comprising copolymerizing poly(ethylene terephthalate) with from 2 to 12 percent by weight of a dicarboxylic acid selected from the group consisting of adipic acid, sebacic acid, glutaric acid, azelaic acid, and isophthalic acid, by preparing a terephthalate ester melt and prior to polymerization thereof adding said dicarboxylic acid to the melt and then polymerizing the melt, and then melt blending polyester homopolymer selected from the group consisting of poly(trimethylene terephthalate), poly(tetramethylene terephthalate, poly(pentamethylene terephthalate), poly(hexamethylene terephthalate), poly(heptamethylene terephthalate), poly(octamethylene terephthalate), poly(nonomethylene terephthalate), and poly(decamethylene terephthalate), under conditions such as to inhibit ester interchange and in weight percentages of from 1 to 10%, based on the total weight of the copolymer.

* * * * *